US009157295B2

(12) United States Patent
Head

(10) Patent No.: US 9,157,295 B2
(45) Date of Patent: Oct. 13, 2015

(54) CONTROL OF FLUID FLOW IN OIL WELLS

(76) Inventor: Philip Head, Egham (GB)

( * ) Notice: Subject to any disclaimer, the term of this patent is extended or adjusted under 35 U.S.C. 154(b) by 462 days.

(21) Appl. No.: 13/304,597

(22) Filed: Nov. 25, 2011

(65) Prior Publication Data

US 2012/0132442 A1 May 31, 2012

(30) Foreign Application Priority Data

Nov. 25, 2010 (GB) ..... 1020031.9

(51) Int. Cl.

| | |
|---|---|
| ***E21B 33/16*** | (2006.01) |
| ***E21B 33/14*** | (2006.01) |
| ***E21B 21/08*** | (2006.01) |
| ***E21B 21/10*** | (2006.01) |
| *E21B 34/00* | (2006.01) |

(52) U.S. Cl.

CPC ..... *E21B 33/16* (2013.01); *E21B 21/08* (2013.01); *E21B 21/10* (2013.01); *E21B 33/14* (2013.01); *E21B 2034/005* (2013.01)

(58) Field of Classification Search

CPC ..... E21B 34/06; E21B 33/13; E21B 33/14; E21B 33/16; E21B 21/08; E21B 21/10

USPC ..... 166/373, 386, 177.3, 153, 177.4, 55; 138/42, 43, 44, 46; 251/118

See application file for complete search history.

(56) References Cited

U.S. PATENT DOCUMENTS

| | | | | | |
|---|---|---|---|---|---|
| 2,575,307 | A * | 11/1951 | Walker | ..... | 166/170 |
| 3,586,104 | A * | 6/1971 | Hyde | ..... | 166/142 |
| 4,287,948 | A * | 9/1981 | Haggard | ..... | 166/170 |
| 4,466,462 | A * | 8/1984 | Morris | ..... | 138/42 |
| 5,404,945 | A * | 4/1995 | Head et al. | ..... | 166/155 |
| 5,673,751 | A | 10/1997 | Head et al. | | |
| 8,312,931 | B2 * | 11/2012 | Xu et al. | ..... | 166/373 |
| 2011/0214861 | A1 * | 9/2011 | Rogers et al. | ..... | 166/281 |

* cited by examiner

*Primary Examiner* — Robert E Fuller
(74) *Attorney, Agent, or Firm* — Fay Sharpe LLP

(57) ABSTRACT

A flow restrictor for controlling the flow of cement or other fluid in oil wells comprises a plurality of restrictor elements, each defining first and second apertures, which are assembled in a stacked configuration and slidingly inserted into the well casing or other tubing so that the first apertures define a direct flowpath, preferably including a non-return valve, and the second apertures define a second, indirect flowpath between the elements and the inner surface of the tubing. The elements include seals for fluidly sealing each element in the bore of the tubing which are preferably slidably retractable and resiliently radially outwardly biased so as to adapt conformably to different tubing types having different internal diameters. The restrictor may slide along the tubing in use.

15 Claims, 7 Drawing Sheets

CONTROL OF FLUID FLOW IN OIL WELLS

This application claims priority to and the benefit of Great Britain patent application number GB 1020031.9, filed Nov. 25, 2010, the entirety of which application is hereby incorporated by reference.

This invention relates to flow restrictors for controlling the rate of fluid flow in boreholes, particularly but not necessarily in oil wells, particularly but not necessarily during cementing operations.

An oil well is drilled using a drill attached to drill pipes and after drilling, casings of successively decreasing diameters are inserted into the drilled hole to seal the section of hole drilled and provide a pressure conduit deeper into the earth. Various fluids are pumped down the drillpipe and casing strings, collectively referred to as "tubing", and there is a need to control the flow of such fluids.

For example, after installing the strings of lining or casing (these terms being synonymous), the casing is cemented in position to prevent fluids from the wellbore from flowing outside the casing. Cementing also seals the exposed formation to prevent high pressure formations flowing into the well, or low pressure formations absorbing fluid from the well.

Cementing is achieved by preparing a cement slurry and then pumping it down the casing. As it is pumped down, the cement slurry displaces the mud already in the casing and passes out of the lower end of the casing and then into and up the exterior of the casing, displacing the mud in front of it. Sufficient cement slurry is prepared to fill a defined volume outside of the casing, this volume being usually slightly in excess of the open hole volume plus an additional amount to come back to the previous casing annulus. The end of the casing includes a non return valve which, when cementing is complete, prevents the cement from passing back up inside the casing.

The cement slurry has a density which is greater than the density of the mud which it displaces. This can result in a phenomenon known as U tubing in which the force resisting the flow of cement is insufficient to allow the pumping pressure to be maintained and the cement slurry falls in the casing under the effect of gravity faster than the pumping rate. Accordingly, when U tubing occurs, the cement slurry is no longer under the control of the pump.

This is undesirable because the increased flow rates in U tubing can cause a strongly turbulent flow which can erode weak formations and cause loss of circulation into the weak formation, and can cause very slow flow rates which can cause the drilling mud to be bypassed leaving channels of mud in the cement casing annulus. Further it can result in a vacuum being formed behind the U tubing cement slurry and the slurry may halt while the displacement mud is pumped behind the cement slurry. It can also cause surging in the rate which the mud is forced to the surface and this can be difficult to control without causing unfavourable pressure increases downhole. These effects may be more severe where deep water drilling is undertaken due to the very large differential pressures generated by the ambient pressure of the water column.

In order to control or prevent U tubing, one or more flow restrictors may be installed in the tubing downhole so as to provide an indirect flowpath which limits the downward rate of flow of the cement.

By resisting upward flow of fluids through the casing, flow restrictors may however exacerbate the surge effect which is observed when installing the casing in the borehole, whereby undesirable pressures are exerted on the open formation below and around the casing. In order to reduce this effect, the speed at which the casing is installed in the well must be limited, or otherwise a sufficiently large, direct flowpath must be provided through which fluids may flow more rapidly upwards through the flow restrictor, bypassing the indirect flow passage which throttles downwardly flowing fluids.

U.S. Pat. No. 5,673,751 discloses a flow restrictor comprising a plurality of restrictor elements coupled together in a stacked configuration to define a first, direct flowpath which is selectively sealable and a second, indirect flowpath which throttles downwardly flowing fluid. The elements may be installed inside a portion of tubular casing so that the indirect flowpath is defined between each element and the wall of the casing portion; alternatively the stacked elements may be surrounded by a wiper plug which is slidably received in a tubing string, which however necessarily reduces the overall diameter of the restrictor device and hence the cross-sectional area of the respective flowpaths.

Variations in the internal dimensions of steel casing, reflecting different casing specifications corresponding to different working pressures or tensile loads, can require such flow restrictors to be provided in a corresponding variety of specifications, which is logistically problematic.

It is an object of the invention to provide a flow restrictor of the above mentioned type, particularly for reducing U tubing, which is more convenient in use and which preferably also minimises the surge effect when installing it downhole.

Accordingly the present invention in its various aspects provides a device, apparatus and method as defined in the claims.

Advantageously, the novel flow restrictor is slidingly received in the tubing and provides an indirect flow path which is defined between the body of each restrictor element and the tubing, which is to say that the fluid flowing through the indirect flow path is contained by the tubing, the inner wall of the tubing forming a respective wall of the flowpath, and hence dispenses with the need for a separate outer housing. This maximises the diameter of the device and hence the diameter of the direct flowpath, minimising the surge effect so that the device can be installed more rapidly into the borehole. Moreover, since the seals are preferably arranged to conform to a range of different internal tubing diameters, by slidably installing the device into the tubing rather than cementing or otherwise bonding each element to the inner wall of a portion of casing which forms a permanent housing, the device may also be installed in different types of tubing having different internal diameters while any concern as to the grade of casing material or casing traceability or the like is also eliminated. Advantageously these advantages are realised while optionally also allowing the device to slide along the tubing in use, which is convenient in deployment and use.

Further features and advantages will be evident from the following illustrative embodiments which are described, purely by way of example and without limitation to the scope of the claims, and with reference to the accompanying drawings, in which:

Corresponding reference numerals indicate corresponding features in each of the figures.

Figure 1:
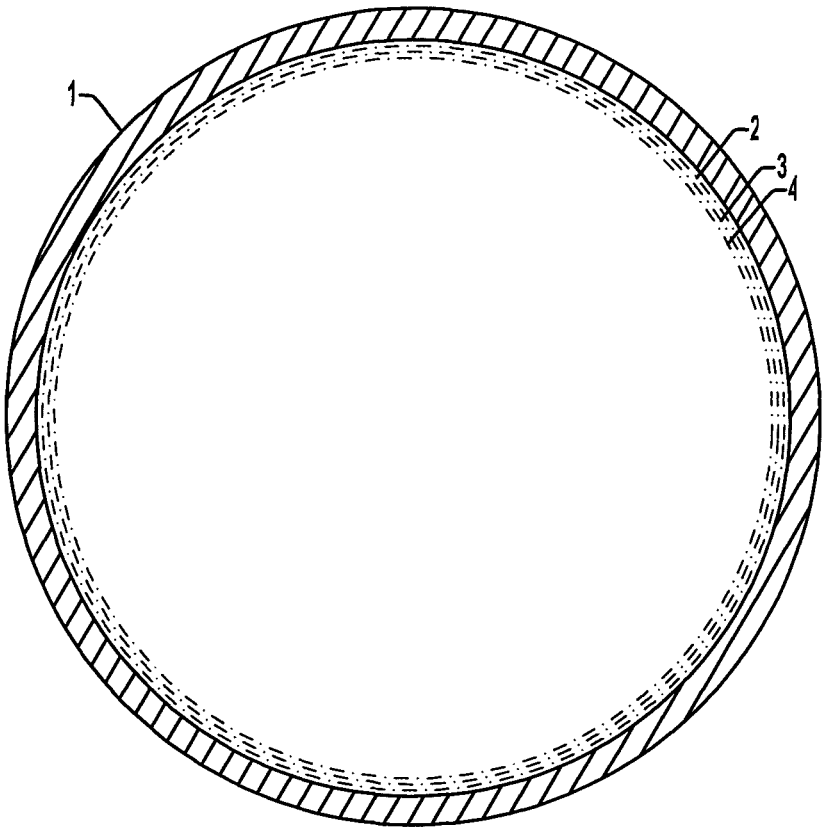
FIG. 1 is a cross section of a casing.
Figure 2:
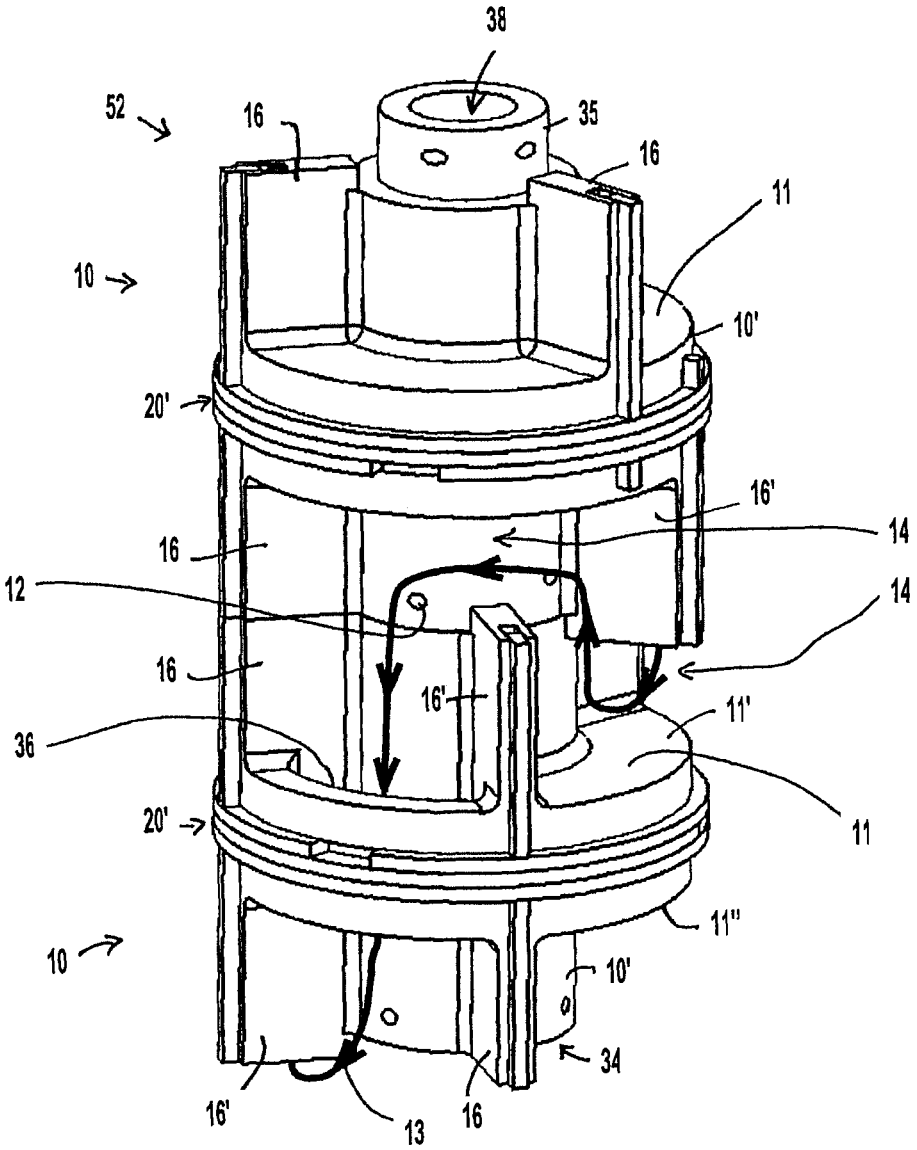
FIG. 2 is an isometric view of a flow restrictor device comprising two flow restrictor elements in a stacked configuration as they would be inside the casing shown in FIG. 1, with the casing removed for clarity.
Figure 3:
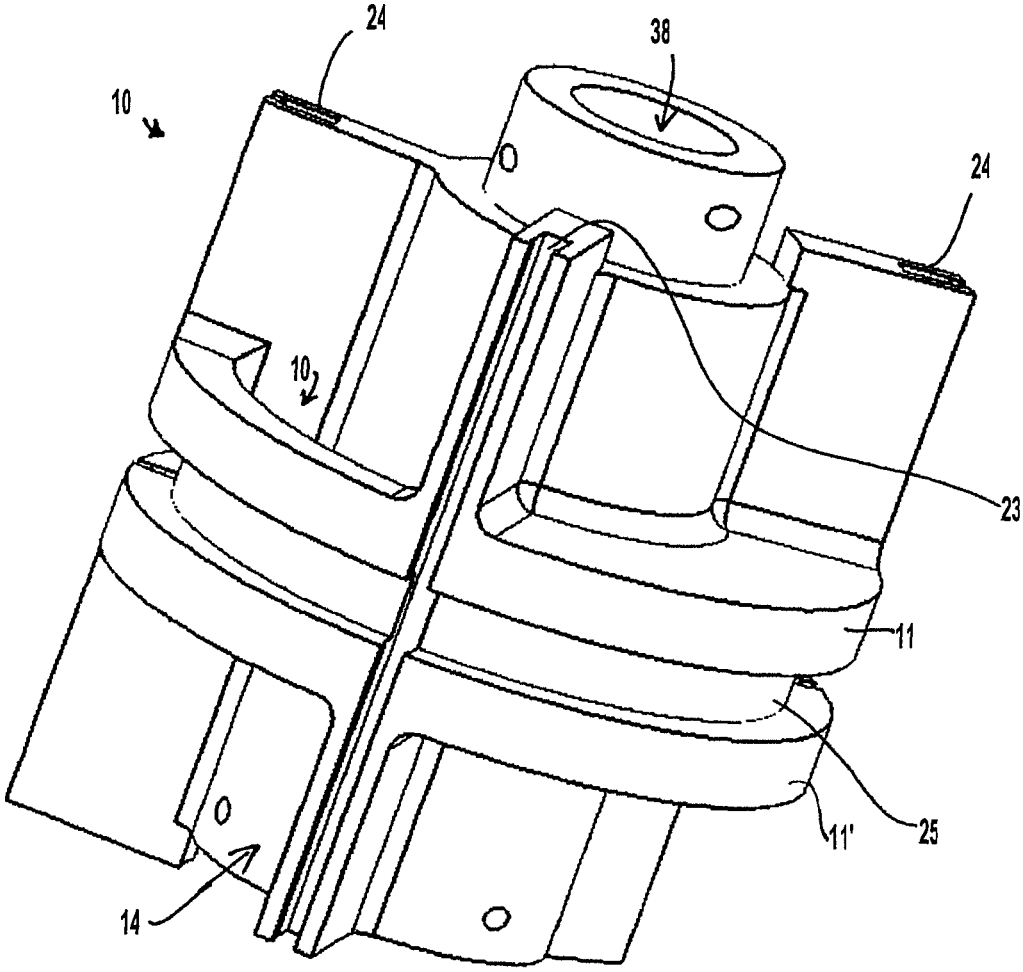
FIG. 3 is an isometric view of one of the flow restrictor elements of the device of FIG. 2.
Figure 4:
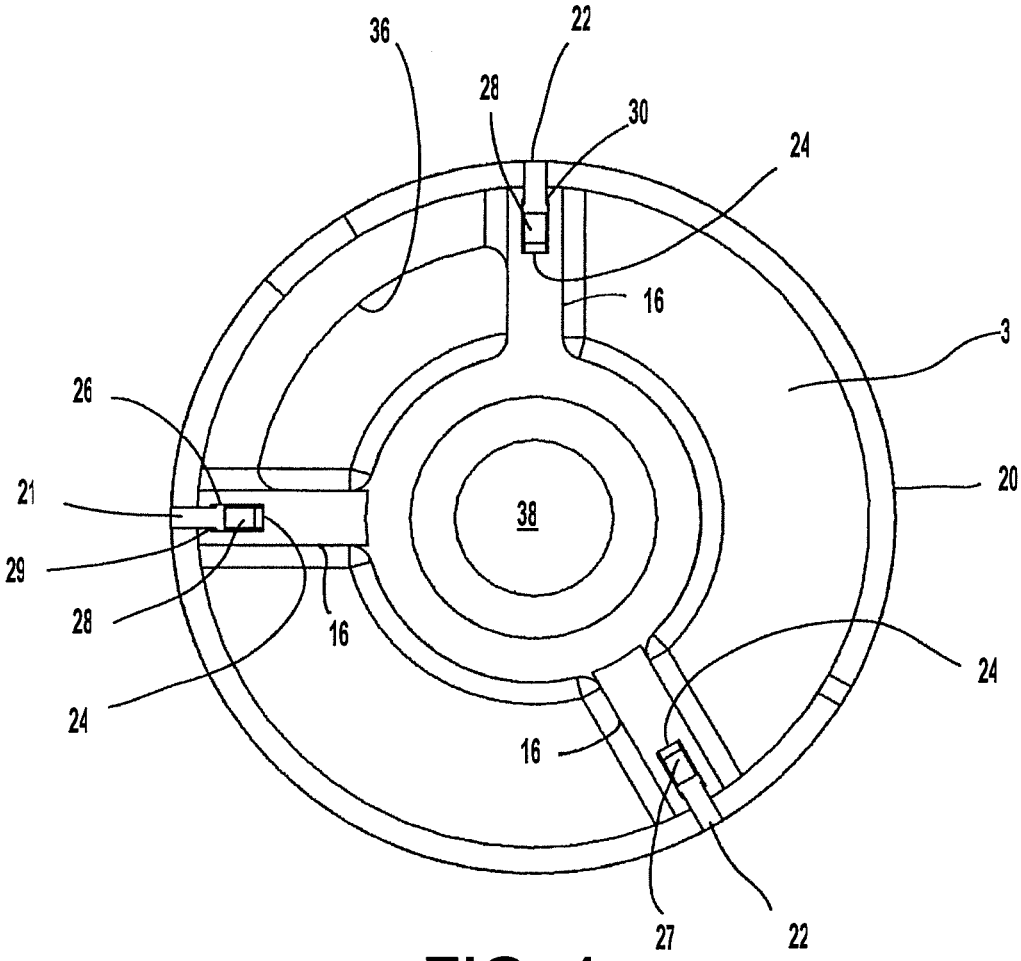
FIG. 4 is a top end view of the element shown in FIG. 3.
Figure 7:
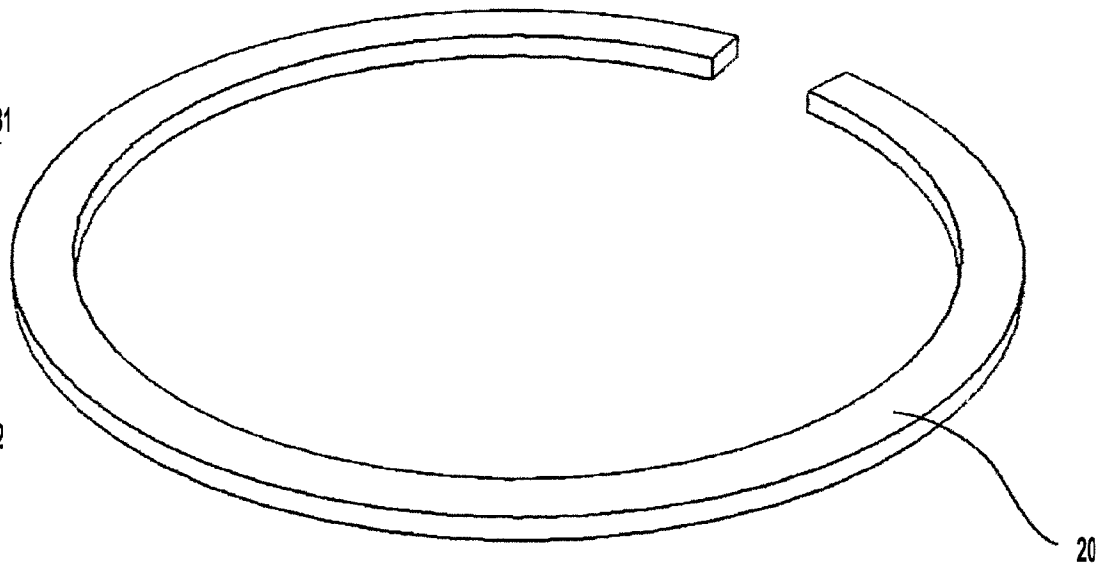
FIG. 7 is an isometric view of one of the split rings which fits into the element of FIG. 3.
Figure 6:
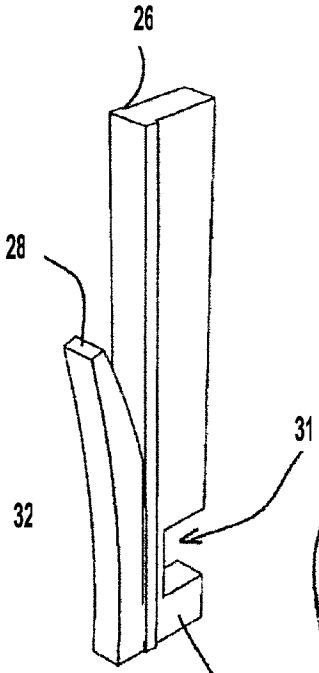
FIG. 6 is an isometric view of another one of the spring loaded vertical elements which fits into the element of FIG. 3.
Figure 5:
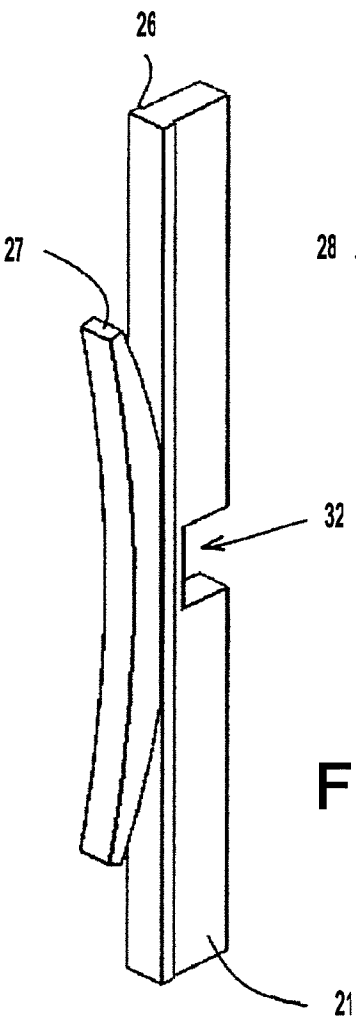
FIG. 5 is an isometric view of one of the spring loaded vertical elements which fits into the element of FIG. 3.
Figure 8:
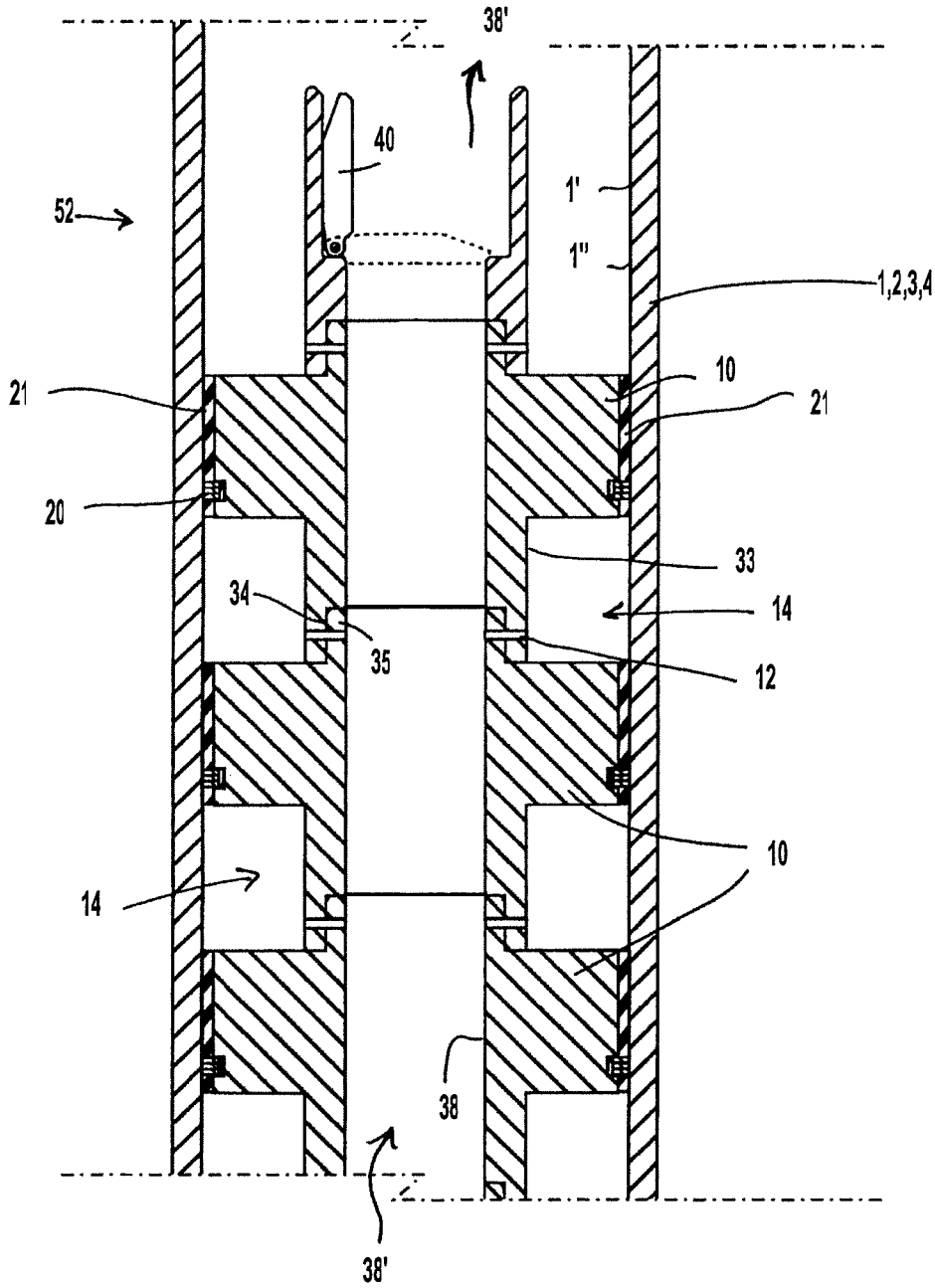
FIG. 8 is a longitudinal section through a flow restrictor device comprising a series of stacked flow restrictor elements slidingly received in a casing with a non return valve fitted to the central flow passage.

Referring to the figures, FIG. 1 shows a typical well casing 1 of 7" external diameter (OD) with a 6.456" internal diameter (ID) equal to a casing weight (wt) of 20 lb/ft. (#/ft). Several other ID's are shown in a dashed line, those being 23#/ft being 6.366" ID (2) 26#/ft being 6.276" ID (3) and 29#/ft being 6.184" ID (4). In addition, casings have an out of round tolerance and drift tolerance along their length. Casings also have many different threads machined onto them, sometimes of standard type but more often being premium custom threads providing gas tightness and bending capacity suitable for deviated and horizontal wells. Finally, they are also available in many different grade materials, for increased pressure and collapse rating, and tensile load carrying ability. Clearly this makes it very difficult to make a device for a specific well, which might need to be optimised or changed at the very last minute.

In a first embodiment a restrictor device 52 comprises two identical restrictor elements 10, also referred to hereinafter as modules, although in practice it could comprise many more. Each module comprises a recess 34 in the base and a matching protrusion 35 on its top, the recess receiving the protrusion of the adjacent module when the modules are assembled and coupled together by means of pins 12 in a stacked configuration as shown. Each module comprises a body 10' which includes a circular plate 11 having a central axis X1-X1 which is aligned in use with a longitudinal axis X2 of the tubing, and a core comprising a tubular conduit 33 which passes substantially centrally through the plate and defines a first, central aperture 38. A second aperture 36 is formed in the plate 11, and an open portion 14 (i.e. a portion which is radially outwardly open and not radially outwardly bounded by an outer wall) communicates with the second aperture 36. The first apertures 38 are arranged in fluid communication to define a first, direct flowpath 38' extending through the device.

The body 10' of each restrictor element includes at least a first seal 20' which is arranged at a periphery 11' of the plate 11 and seals the body in a bore 1' of the tubing when the device is slidingly received therein, engaging sealingly against its inner wall 1". When deployed in the tubing 1, 2, 3, 4, 50 or 51, the second apertures 36 are arranged in fluid communication to define a second, continuous, indirect flowpath 13 (shown by the thick solid arrowed line) extending through the device. The second flowpath extends around the core 33 and through the open portions 14 between the body 10' of each module and the inner wall 1" of the tubing, providing a reduced flow area which generates a small choking pressure for the flow.

Advantageously the body includes at least two walls 16, 16' connected to the plate 11 and extending radially outwardly from the tubular conduit in angularly spaced relation, which help to stabilise the body in the tubing as well as defining the serpentine configuration of the second flowpath 13. In the example shown, the body includes three upper walls 16, 16' connected to an upper side 11' of the plate 11 and three lower walls 16, 16' connected to a lower side 11" of the plate 11, the walls extending radially outwardly from the tubular conduit 33 in angularly spaced relation as shown. Each wall 16' forms a baffle 16' which extends from the plate into the open portion 14 so that the second flowpath is diverted around the baffle as shown.

Each wall has a second seal 21, 22 which is arranged to seal the respective wall or baffle against the inner surface of the tubing in use and is preferably also made from substantially incompressible material such as a resilient metal or plastics material and slidingly retractable against a resilient restoring force which urges it outwardly from the body. The indirect flowpath thus comprises a series of sequentially connected flowpath portions formed between the body and the tubing and separated inter alia by the first and second seals.

The first seal preferably comprises at least a first seal element, conveniently comprising a split ring, made from substantially incompressible material such as a resilient metal or plastics material, and is slidingly radially inwardly retractable against a resilient restoring force which urges it radially outwardly from the body; the restoring force may be provided by the elastic deformation of all or part of the seal element or, less conveniently, by a separate resilient biasing element. Preferably the first and second seal elements are slidingly retractable into respective slots 25, 23, 24 in the body.

If a plurality of these modules are stacked together then an optimum pressure restriction can be achieved for the different density fluids being pumped down the casing. To enable the restrictor module to work in any casing ID size, each first seal 20' comprises one or more split rings 20 made from a resilient metal providing an integral restoring force.

The second seals comprising sprung vertical blockers 21 and 22 are slidingly arranged in recesses 23, 24, 25 on the restrictor module. The vertical blockers are top hat shaped 26 and are slidingly received in the respective slots. They include integral spring fingers 27, 28 which push them outwardly from the respective slots 23, 24 into contact with the inner wall of the tubing. The fingers 27, 28 are restrained (so as to hold them in place during assembly and before inserting the device into the tubing) by a reduced width shoulder 29, 30 in the insert module. A set of split rings 20 are fitted in the groove 25, and also in the aligned undercuts 31, 32 in the vertical blockers 21, 22. The sprung fingers 27 and 28 fill the respective space behind the sprung blockers preventing any flow down this passage. The rings and blockers are urged outwardly by their integral resilient restoring force to conform to the internal diameter of the tubing, compensating for the different tubing weights and dimensional tolerances and drifting along its length, and require minimum force to install.

Flow passes through each module though the second aperture 36 cut in a 90 degree segment of the flat plate 11 of the flow restrictor. The central aperture 38 of the connected restrictors may be used to allow flow from below the casing to inside the casing while the casing is lowered into the well so as to prevent swab and/or surge effects as the casing is deployed, and preferably includes a non return valve 40 which prevents downward flow through the central passage from within the casing so that the cement or other fluid is constrained to pass through the indirect flowpath.

Alternatively the central passage may be selectively closed, e.g. by providing a seat which sealingly receives a ball or the like dropped down the casing as known in the art.

FIGS. 8 to 11 illustrate a particular application of the device in an open borehole in deep water, where a riser is not in use. This exaggerates the effect of U tubing due to the ambient pressure resulting from the depth of the ocean at the upper end of the borehole. The effect of U tubing differential pressure could be so severe that the mechanical strength of the liner 50 could be compromised. The illustrated arrangement could also be used in a terrestrial borehole.

Figure 9:
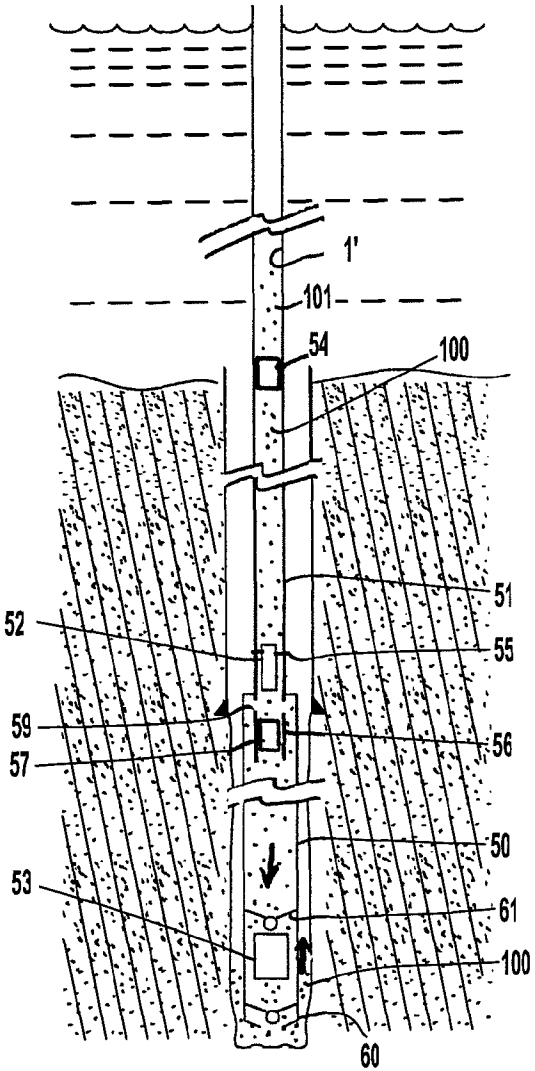
FIG. 9 illustrates the insert flow restrictor in use in a deep water well.

In this example, the liner or casing string 50 is conveyed on drillpipe 51. An upper restrictor 52 is slidingly received in the lower end of the drillpipe 51 and restrained by shearable pins 55 while a lower restrictor 53 is slidingly received in the liner 50 below the restrictor 52 and in-between the float shoe 60 (a nose located at the lower end of the casing string and usually including a nonreturn valve) and the float collar 61 (another, redundant nonreturn valve usually located one casing length above the float shoe.) The upper restrictor 52 has a very high flow restriction setting as compared with the lower restrictor 53, as the drill pipe has a greater differential pressure rating than the liner. A lower top plug 57 is arranged in a constrictor tube 56 at the lower end of the drillpipe. The constrictor tube has bypass apertures 59 located above the lower top plug 57, which is compressed in the constrictor tube so that the cement 100, which is pumped down the drillpipe and followed by a displacement fluid 101, can flow through the upper restrictor 52, out through the bypass apertures 59 and down around the constrictor tube 56 into the liner 50, and then down through the float collar 61, lower restrictor 53 and float shoe 60 and up the annulus around the lining 50 (FIG. 9.)

Figure 10:
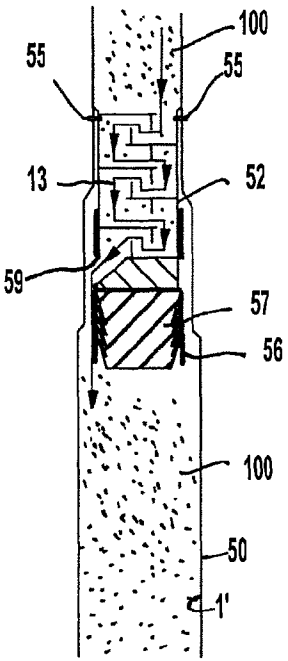

An upper top plug 54 as known in the art, typically made from drillable material, forms a sliding seal in the drillpipe between the displacement fluid and the cement. The upper top plug is urged down the drillpipe by the displacement fluid (e.g. mud) 101 above it to displace the cement 100 beneath it (FIG. 10).

Figure 12:
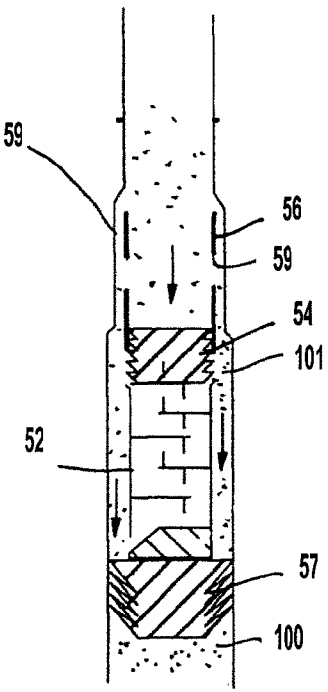
FIGS. 10, 11 and 12 show sequential steps in a cementing operation in the embodiment of FIG. 9.
Figure 11:
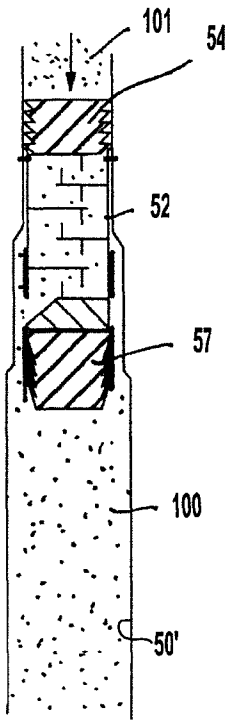

When the upper top plug 54 reaches the restrictor 52 (FIG. 11), the increase in pressure shears the pins 55 to release the restrictor (FIG. 12.) The upper top plug 54 then pushes the restrictor slidingly down so that it displaces the lower top plug 57, pushing it out of the constrictor tube 56. The upper top plug 54 and top restrictor 52 follow the lower top plug 57 through the constrictor tube 56; as it passes into the lining 50, the lower top plug 57 expands to sealingly engage the inner wall 50' of the lining 50 and displaces the cement beneath it as it is displaced down the lining by the displacement fluid 101 above.

By arranging the upper restrictor device slidingly and sealingly in the tubing it is possible to provide variant arrangements which, for example, may advantageously simplify the coupling between the drillpipe and the lining by avoiding the need for the constrictor tube 56.

For example, in a variant (not illustrated), the top restrictor may be slidingly and sealingly received in the lining and restrained by shear pins, with the lower top plug arranged in a constrictor element beneath the top restrictor, allowing cement to flow past it. When the upper top plug reaches the upper restrictor the pins are sheared so that the upper restrictor pushes the lower top plug out of the restrictor element, allowing it to expand to sealingly engage the inner surface of the lining. The constrictor element may then be released, e.g. by further shear pins, and pushed down the lining between the upper restrictor and the lower top plug.

In a yet further variant (not illustrated), the upper restrictor may be slidingly and sealingly received in the lining 50 and restrained by shear pins, and provide a seat on its upper surface defining a fluid orifice communicating with either the second, indirect flowpath or with both flowpaths and adapted to sealingly receive the lower surface of the upper top plug so as to block at least the second flowpath. The upper restrictor then functions as the lower top plug, separating the displacement fluid from the cement as it travels slidingly down the lining.

The novel flow restrictor device could be deployed together with the tubing, or alternatively by sliding it down inside an already deployed casing; surge is minimised in both cases by the relatively large direct flowpath. It may be located in a use position for example by abutment against an internal landing feature in the casing, or by shear pins.

Optionally, a bottom plug can be located at the lower end of the cement volume to displace mud or other fluid beneath it. The bottom plug has a diaphragm which is ruptured by the increase in pressure from the cement above once it has travelled down to reach the float collar 61 or other obstacle in the tubing, allowing the cement to continue to flow down past the bottom plug and into the annulus.

In summary, a preferred embodiment provides a flow restrictor for controlling the flow of cement or other fluid in oil wells, comprising a plurality of restrictor elements, each defining first and second apertures, which are assembled in a stacked configuration and slidingly inserted into the well casing or other tubing so that the first apertures define a direct flowpath, preferably including a non-return valve, and the second apertures define a second, indirect flowpath between the elements and the inner surface of the tubing. The elements include seals for fluidly sealing each element in the bore of the tubing which are preferably slidably retractable and resiliently radially outwardly biased so as to adapt conformably to different tubing types having different internal diameters. The restrictor may slide along the tubing in use.

Instead of forming the restrictor elements as separate elements and assembling them together, they may alternatively be formed as a unitary device.

The second aperture is preferably formed in the plate, in which case the device advantageously defines a flow rate which is substantially independent of the diameter of the tubing, but alternatively the second aperture could be formed as a notch in the periphery of the plate, with the first seal being interrupted at the notch.

Although the novel device has been described above by reference to cementing operations in which it is used to control the flow of cement, it may also be fitted in well casings or production tubing so as to control the flow of other fluids, including for example production fluid pumped down the well to control production from various formations, or kill fluid pumped down the well, or other fluids pumped down the well to stimulate production from various formations. It may also be used in boreholes other than oil wells.

The invention claimed is:

1. A device for restricting the flow of a fluid through tubing installed in a borehole, the device including a plurality of restrictor elements coupled together in a stacked configuration, each restrictor element including a body, the body having a first aperture, a second aperture, and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion such that in use the second flowpath is defined between the body and an inner wall of the tubing;

wherein the body of each restrictor element includes at least a first seal for sealing the body in a bore of the tubing when the device is slidingly received therein;

wherein the body includes a circular plate having a central axis which is aligned in use with a longitudinal axis of the tubing, and at least one baffle which extends from the plate into the open portion so that the second flowpath is diverted around the baffle; and the first seal is arranged at a periphery of the plate, and a second seal is arranged to seal the baffle against the inner surface of the tubing in use.

2. The device according to claim 1, wherein the first flowpath includes a non-return valve.

3. The device according to claim 1, wherein the first seal comprises at least a first seal element made from substantially incompressible material, and the first seal element is slidingly retractable against a resilient restoring force which urges it outwardly from the body.

4. The device according to claim 3, wherein the first seal element is slidingly retractable into a slot in the body.

5. The device according to claim 3, wherein the first seal element comprises a split ring.

6. A device for restricting the flow of a fluid through tubing installed in a borehole, the device including a plurality of restrictor elements coupled together in a stacked configuration, each restrictor element including a body, the body having a first aperture, a second aperture, and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion such that in use the second flowpath is defined between the body and an inner wall of the tubing;

wherein the body of each restrictor element includes at least a first seal for sealing the body in a bore of the tubing when the device is slidingly received therein;

wherein the body of each restrictor element includes a circular plate having a central axis which is aligned in use with a longitudinal axis of the tubing, the first seal being arranged at a periphery of the plate, and the first aperture is defined by a tubular conduit passing substantially centrally through the plate; and wherein the body includes at least two walls connected to the plate and extending radially outwardly from the tubular conduit in angularly spaced relation; and each wall has a second seal arranged to seal the respective wall against the inner surface of the tubing in use.

7. A device for restricting the flow of a fluid through tubing installed in a borehole, the device including a plurality of restrictor elements coupled together in a stacked configuration, each restrictor element including a body, the body having a first aperture, a second aperture, and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion such that in use the second flowpath is defined between the body and an inner wall of the tubing;

wherein the body of each restrictor element includes at least a first seal for sealing the body in a bore of the tubing when the device is slidingly received therein;

wherein the body of each restrictor element includes a circular plate having a central axis which is aligned in use with a longitudinal axis of the tubing, the first seal being arranged at a periphery of the plate, and the first aperture is defined by a tubular conduit passing substantially centrally through the plate; and wherein the body includes three upper walls connected to an upper side of the plate and three lower walls connected to a lower side of the plate, the walls extending radially outwardly from the tubular conduit in angularly spaced relation; and each wall has a second seal arranged to seal the respective wall against the inner surface of the tubing in use.

8. A method of restricting the flow of a fluid through tubing in a borehole, comprising:

providing a plurality of restrictor elements, each restrictor element including a body, the body having a first aperture, a second aperture, an open portion communicating with the second aperture, and at least a first seal for sealing the body in a bore of the tubing;

coupling the restrictor elements together in a stacked configuration to form a restrictor device; and inserting the device slidingly into the bore of the tubing such that the body of each restrictor element is sealed in the bore by the respective first seal, the respective first apertures are arranged in fluid communication to define a first, direct flowpath extending through the device, and the respective second apertures are arranged in fluid communication to define a second, indirect flowpath extending through the device, the second flowpath extending through the open portion of each restrictor element between the respective body and an inner wall of the tubing;

wherein the device is arranged to slide along the bore of the tubing in use; and wherein the device is restrained in the tubing by shearable pins and released by shearing the pins.

9. A method of restricting the flow of a fluid through tubing in a borehole, comprising:

providing a plurality of restrictor elements, each restrictor element including a body, the body having a first aperture, a second aperture, an open portion communicating with the second aperture, and at least a first seal for sealing the body in a bore of the tubing:

coupling the restrictor elements together in a stacked configuration to form a restrictor device: and inserting the device slidingly into the bore of the tubing such that the body of each restrictor element is sealed in the bore by the respective first seal, the respective first apertures are arranged in fluid communication to define a first, direct flowpath extending through the device, and the respective second apertures are arranged in fluid communication to define a second, indirect flowpath extending through the device, the second flowpath extending through the open portion of each restrictor element between the respective body and an inner wall of the tubing;

wherein the device is arranged to slide along the bore of the tubing in use; and wherein the tubing includes a float collar and a float shoe, and the device is arranged to slide in the tubing between the float collar and the float shoe.

10. The method according to claim 9, wherein the float shoe includes a nonreturn valve.

11. A method of restricting the flow of a fluid through tubing in a borehole, comprising:

providing a plurality of restrictor elements, each restrictor element including a body, the body having a first aperture, a second aperture, an open portion communicating with the second aperture, and at least a first seal for sealing the body in a bore of the tubing;

coupling the restrictor elements together in a stacked configuration to form a restrictor device; and inserting the device slidingly into the bore of the tubing such that the body of each restrictor element is sealed in the bore by the respective first seal, the respective first apertures are arranged in fluid communication to define a first, direct flowpath extending through the device, and the respective second apertures are arranged in fluid communication to define a second, indirect flowpath extending through the device, the second flowpath extending through the open portion of each restrictor element between the respective body and an inner wall of the tubing;

wherein the device is arranged to slide along the bore of the tubing in use; and wherein the tubing is deployed in the borehole and then the device is deployed by sliding it down inside the tubing and restrained by abutment against an internal landing feature in the tubing.

12. An apparatus comprising a tubing installed in a borehole and a restrictor device installed in the tubing so as to restrict the flow of a fluid through the tubing;

the restrictor device including a plurality of restrictor elements coupled together in a stacked configuration, each restrictor element including a body, the body having a first aperture, a second aperture. and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion of each restrictor element between the body and an inner wall of the tubing;

wherein the device is arranged to slide along a bore of the tubing in use, and the body of each restrictor element includes at least a first seal which is slideably engaged against an inner wall of the tubing so as to seal the body in the bore; and wherein the device is restrained in the tubing by shearable pins and releasable by shearing the pins.

13. An apparatus comprising a tubing installed in a borehole and a restrictor device installed in the tubing so as to restrict the flow of a fluid through the tubing:

the restrictor device including a plurality of restrictor elements coupled together in a stacked configuration, each restrictor element including a body, the body having a first aperture, a second aperture, and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion of each restrictor element between the body and an inner wall of the tubing;

wherein the device is arranged to slide along a bore of the tubing in use, and the body of each restrictor element includes at least a first seal which is slideably engaged against an inner wall of the tubing so as to seal the body in the bore; and wherein the tubing includes a float collar and a float shoe, and the device is arranged to slide in the tubing between the float collar and the float shoe.

14. The apparatus according to claim 13, wherein the float shoe includes a nonreturn valve.

15. An apparatus comprising a tubing installed in a borehole and a restrictor device installed in the tubing so as to restrict the flow of a fluid through the tubing:

the restrictor device including a plurality of restrictor elements coupled together in a stacked configuration, each restrictor element including a body, the body having a first aperture, a second aperture, and an open portion communicating with the second aperture, the respective first apertures being arranged in fluid communication to define a first, direct flowpath extending through the device, the respective second apertures being arranged in fluid communication to define a second, indirect flowpath extending through the device, the second flowpath extending through the open portion of each restrictor element between the body and an inner wall of the tubing;

wherein the device is arranged to slide along a bore of the tubing in use, and the body of each restrictor element includes at least a first seal which is slideably engaged against an inner wall of the tubing so as to seal the body in the bore; and wherein an internal landing feature is arranged in the tubing, and the device is deployable by sliding said device down inside the tubing until said device is restrained by abutment against the internal landing feature.

* * * * *